US005259427A

United States Patent [19]

Grooms et al.

[11] Patent Number: 5,259,427

[45] Date of Patent: Nov. 9, 1993

[54] PACKAGE SYSTEM FOR COLLECTION-TRANSPORT OF WASTE LIQUIDS

[75] Inventors: John M. Grooms; Blake V. Ricks, both of Rochester, Ind.

[73] Assignee: Burton Mechanical Contractors, Inc., Rochester, Ind.

[21] Appl. No.: 829,742

[22] Filed: Jan. 31, 1992

[51] Int. Cl.[5] ..... B65B 1/30; B65B 31/00; B67C 3/02

[52] U.S. Cl. ..... 141/95; 141/88; 141/198; 137/403; 137/396; 4/321; 4/323

[58] Field of Search ..... 141/46, 86, 88, 83, 141/95, 198, 98; 173/403, 406, 396, 414, 205, 907; 4/655, 321, 323; 417/118, 138, 146, 139; 251/29

[56] References Cited

U.S. PATENT DOCUMENTS

Re. 28,008 5/1974 Liljendahl ..... 137/414
3,777,778 12/1973 Janu ..... 4/323
4,171,853 10/1979 Cleaver et al. ..... 406/48
4,373,838 2/1983 Foreman et al. ..... 406/14
5,078,174 1/1992 Grooms et al. ..... 137/236.1

*Primary Examiner*—Henry J. Recla
*Assistant Examiner*—Steven O. Douglas
*Attorney, Agent, or Firm*—Jones, Day, Reavis & Pogue

[57] ABSTRACT

An integral, vacuum operated, package system for collecting and transporting waste liquids from, e.g., a defrosted freezer, sink, bathtub, or water fountain, to a vacuum transport conduit connected to a vacuum collection station. The package system preferably includes a collection sump, sensor valve, controller valve, vacuum volume, and vacuum valve, which operatively communicate with each other by means of applied differential pressure to withdraw waste liquid from the collection sump and pass it through an opened vacuum valve during a transport cycle. The package system is compact, portable, and easily installed and maintained, and may be concealed in most applications, since it requires a mere volume generally measuring 12"×8"×3½."

31 Claims, 8 Drawing Sheets

PACKAGE SYSTEM FOR COLLECTION-TRANSPORT OF WASTE LIQUIDS

BACKGROUND OF THE INVENTION

The present invention relates generally to vacuum-operated waste liquid control systems utilizing inlet vacuum valves and operative control means, and more specifically to an integral package system thereof containing a sump, vacuum valve, and sensor-controller, which is compact and portable, and may be easily installed.

An operational vacuum system for transporting waste liquids, such as sewage, is disclosed in U.S. Pat. No. 4,179,371 issued to Foreman et al. Each waste liquid inlet point includes a vacuum valve and controller assembly, which allows intermittent passage of waste liquid accumulated in a holding tank or sump into an associated transportation conduit network connected at the other end to a collection tank, and thereafter ultimately to a treatment plant. As taught by the '371 patent, this conduit is typically laid with a saw-toothed profile with a combination of riser, low point, and downslope portions (collectively called a "lift") repeated throughout the length of the conduit main to accommodate the topography (e.g., other conduits and rock layers), as well as incoming flows (from an individual vacuum valve or branch main). The conduits of the '371 patent are buried beneath ground level, and are used to transport sewage.

The slope of the downsloped portions of the profile is such that the drop between lifts is generally equivalent to at least 40% of the conduit diameter (80% if the diameter is smaller than 6") or 0.2% of the distance between lifts, whichever is greater. Generally, the transport conduit network is continuously maintained under vacuum or subatmospheric pressure. Upon opening of the vacuum valve to commence a transport cycle, waste liquid and air, usually at atmospheric pressure, are swept through the conduit by means of applied differential pressure until the valve is closed at which point any residual waste liquid not transported through the conduit during the transport cycle comes to rest in a low point therein, thereby permitting vacuum or subatmospheric pressure to generally be communicated and maintained throughout the entire conduit section.

Vacuum valves function within this system by sealing and unsealing the passage between two parts of an evacuated system to define a transport cycle. The general structure and method of operation of this type of vacuum valve is described in U.S. Pat. No. 4,171,853 issued to Cleaver et al., as well as U.S. Pat. Nos. 5,078,174 and 5,082,238 assigned in common to the owner of the present invention.

Operation of the vacuum valve may, in turn, be controlled by a sensor and a controller, either separated or combined, which contain parts operated by means of differential pressure and the hydrostatic pressure condition existing in the sump to determine whether an atmospheric or subatmospheric pressure condition should be communicated to the valve to close or open it, respectively. The general structure and method of operation of such a sensor controller is described in U.S. Pat. Nos. 4,373,838 and 3,777,778.

Numerous applications for vacuum transport systems other than sewage exist. For instance, freezer units used in supermarkets, convenience stores, etc. must be periodically defrosted, thereby creating a source of waste water. Gray water collection from baths and sinks in a residence likewise give rise to waste liquids. Indeed, even a drinking fountain in a school or commercial establishment drains unconsumed water which may be contaminated with other liquids which were poured into the fountain.

The waste water effluents from all of these systems must be sent to a treatment facility. This objective could be achieved by using a sewage vacuum valve and sensor-controller known in the trade in conjunction with a transport conduit buried in the floor of the commercial or residential establishment. However, such systems are generally bulky, expensive, and complicated to install, and better suited for volumes of waste liquids exceeding those arising from freezer units, drinking fountains, sinks, and baths. Moreover, they involve a large number of components (e.g., valve, sensor-controller, sump, pipe, fittings, and mounting brackets), which must be purchased separately and assembled in a space-consuming system.

SUMMARY OF THE INVENTION

Accordingly, it is an object of the present invention to provide an integrated vacuum collection and transport system for waste liquids, which includes a vacuum valve, sensor-controller, and sump, yet is compact, portable, and easy to install.

Another object of the present invention is to provide such a package system which may be installed above ground without need for excavation in commercial and residential establishments.

Other objects of the invention, in addition to those set forth above, will become apparent to those skilled in the art from the following disclosure.

Briefly, the invention is directed to providing an integral, vacuum operated, package system for collecting and transporting waste liquids from, e.g., a defrosted freezer, sink, bathtub, or water fountain, to a vacuum transport conduit connected to a vacuum collection station. The package system preferably includes a collection sump, sensor valve, controller valve, vacuum volume, and vacuum valve, which operatively communicate with each other by means of applied differential pressure to withdraw waste liquid from the collection sump and pass it through an opened vacuum valve during a transport cycle. The package system is compact, portable, and easily installed and maintained, and may be concealed in most applications, since it requires a mere volume generally measuring 12"×8"×3½."

DETAILED DESCRIPTION OF THE PREFERRED EMBODIMENT

Figure 1:
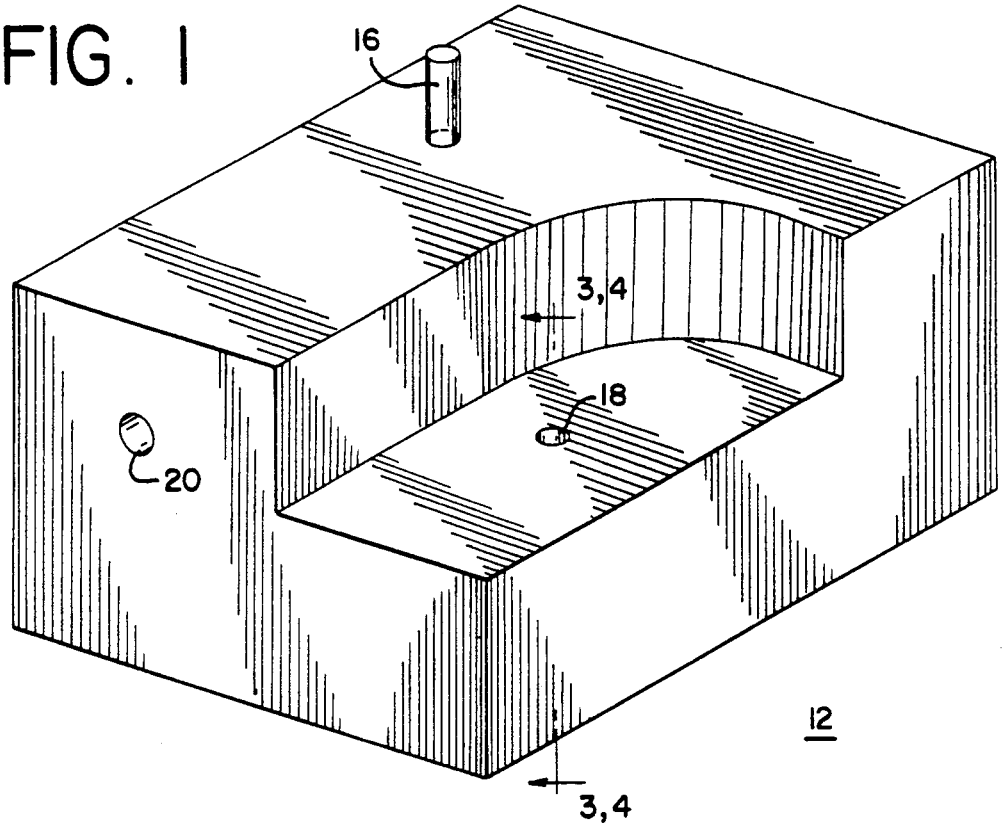
FIG. 1 is a perspective view of the collection sump of the package system of the present invention.
Figure 2:
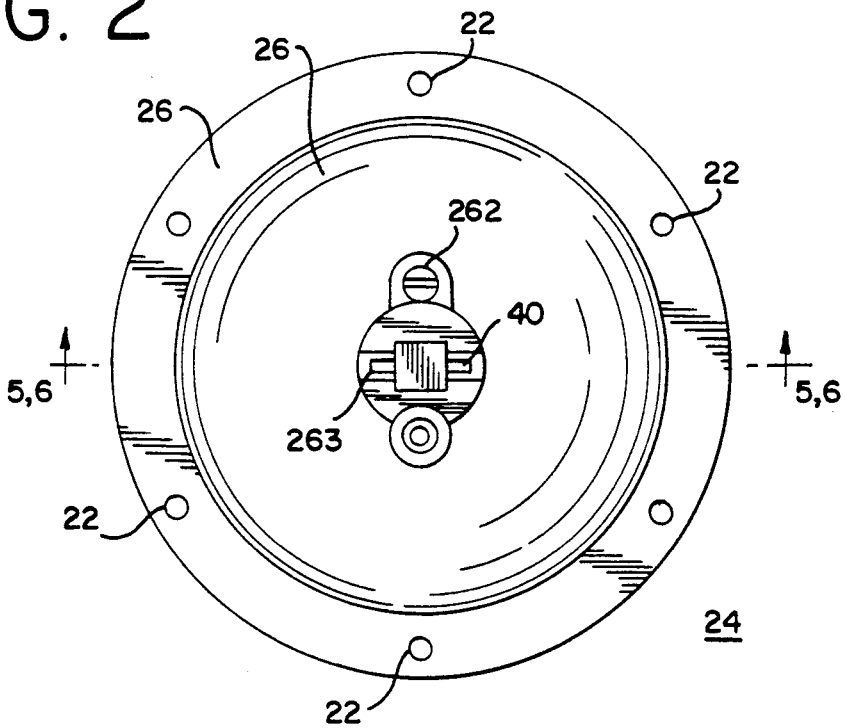
FIG. 2 is a plan view of the sensor valve.

The collection sump 12 of the vacuum-operated collection-transport package system 10 for waste liquids is illustrated in FIG. 1. It comprises a liquid tight vessel made of a suitable material, such as plastic, which is designed to contain a predetermined volume of waste liquid 14, such as approximately 1.0–3.0 liters. Although essentially box-shaped, it has an irregular profile to accommodate a vacuum volume, sensor valve, and control valve, as will be discussed herein, for the sake of providing a more compact overall system package.

An inlet pipe 16 extends through the top surface of the sump for purposes of introducing waste liquid 14. It is to be understood that inlet pipe 16 could enter the sump equally well at another position, such as an upper side surface thereof. Located in a top surface of sump 12 is an aperture 18 for providing operative means of communication between the sump and a sensor valve. Another aperture 20 is located in an upper wall of sump 12 for purposes of operatively connecting the sump to a vacuum valve.

Figure 3:
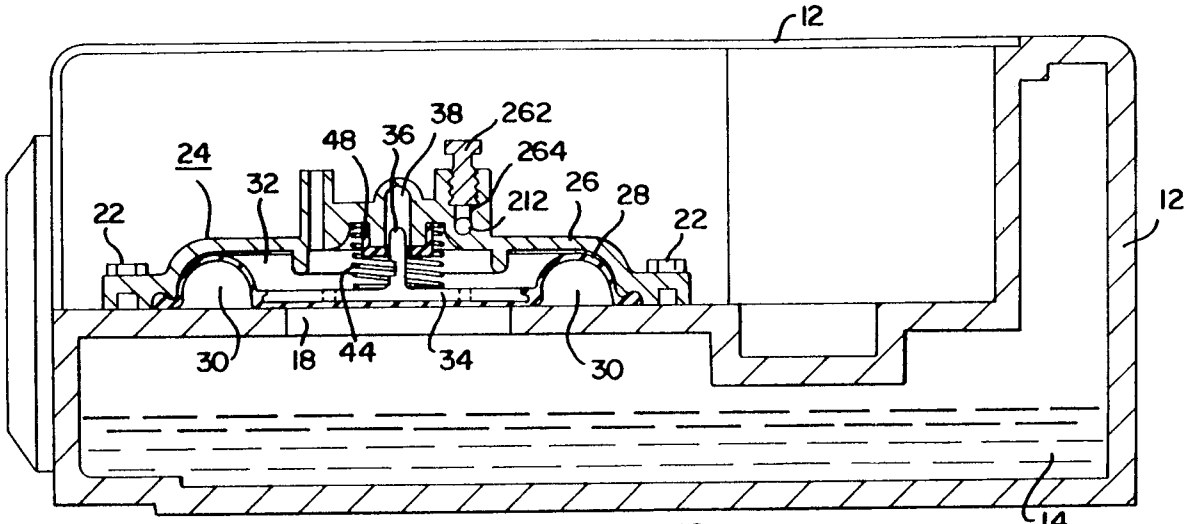
FIG. 3 is a cross-sectional view of the sump taken along line 3—3 of FIG. 1, and the sensor valve in the standby position.
Figure 4:
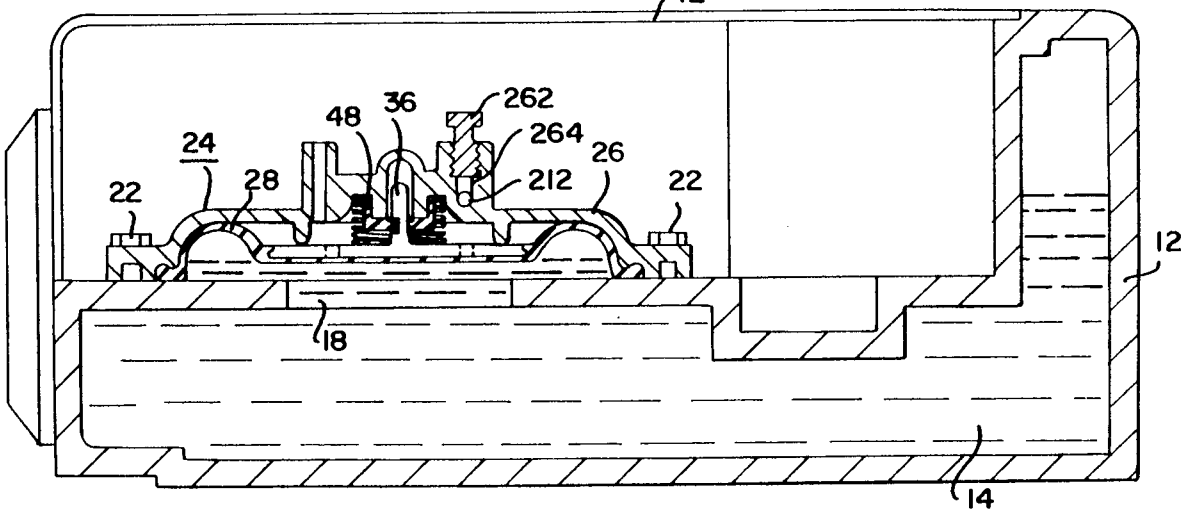
FIG. 4 is a cross-sectional view of the sump taken along line 4—4 of FIG. 1, and the sensor valve in the actuated position.

Sump 12 is illustrated once again in FIGS. 3 and 4, as viewed from its side surface. Waste liquid 14 enters the sump through entry pipe 16, as previously discussed, and accumulates therein. As it accumulates, it produces increasing hydrostatic pressure, which is communicated through aperture 18 in the side top surface wall of sump 12.

Mounted to the sump over aperture 18 by means of screws 22 is sensor valve 24. The sensor valve includes a solid body 26 made of a suitable material, such as plastic, but which has an open bottom. When screwed to sump 12, a liquid and air-tight seal is provided therebetween. Trapped between the bottom surface of sensor valve body 26 and sump 12 is a pliable diaphragm 28 made from a rubber-like material, which serves to divide the sensor valve 24 into chambers 30 and 32, respectively. Mounted on the inside surface of diaphragm 28 is pressure plate 34 from which extends plunger post 36. Plunger post 36 reciprocates inside channel 38 of sensor valve body 26. Channel 38 terminates in a nozzle 40 (see FIGS. 5 and 6) positioned on top of sensor valve body 26, which has an air passage 42 through it.

A spring 44 is positioned between sensor valve body 26 and diaphragm pressure plate 34 to bias diaphragm 28, and therefore plunger post 36 away from channel 38. An undercut region 46 in plunger post 36 permits passage of air through a portion thereof. Normally, this undercut region 46 is positioned below rubber seal 48 mounted on sensor valve body 26 adjacent to plunger post 36 so that atmospheric pressure may not be communicated from chamber 32, through plunger post 36 to channel 38, and through nozzle 40 into the controller valve (see FIGS. 3 and 5). However, when the accumulating waste liquid 14 creates a sufficient level of hydrostatic pressure in chamber 30 exerted against diaphragm 28, plunger post 36 is biased into channel 38 so that the undercut region bypasses rubber seal 48 (see FIGS. 4 and 6). At this point, atmospheric pressure is communicated from chamber 32 to channel 38, and therefore through nozzle 40 to the controller valve.

Figure 7:
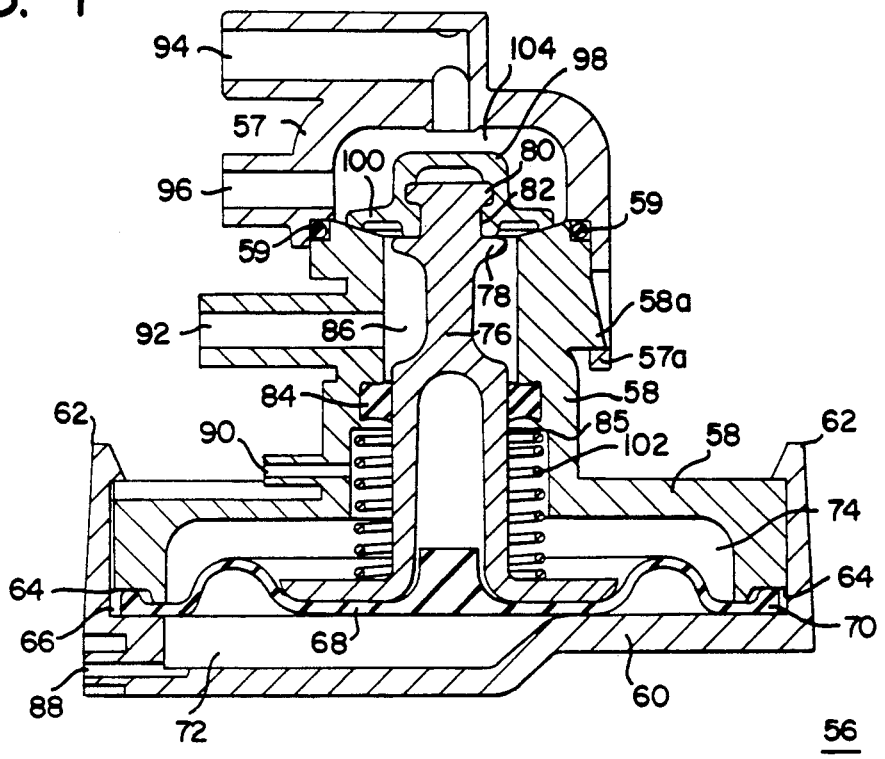
FIG. 7 is a cross-sectional view of the controller valve in the standby position.
Figure 8:
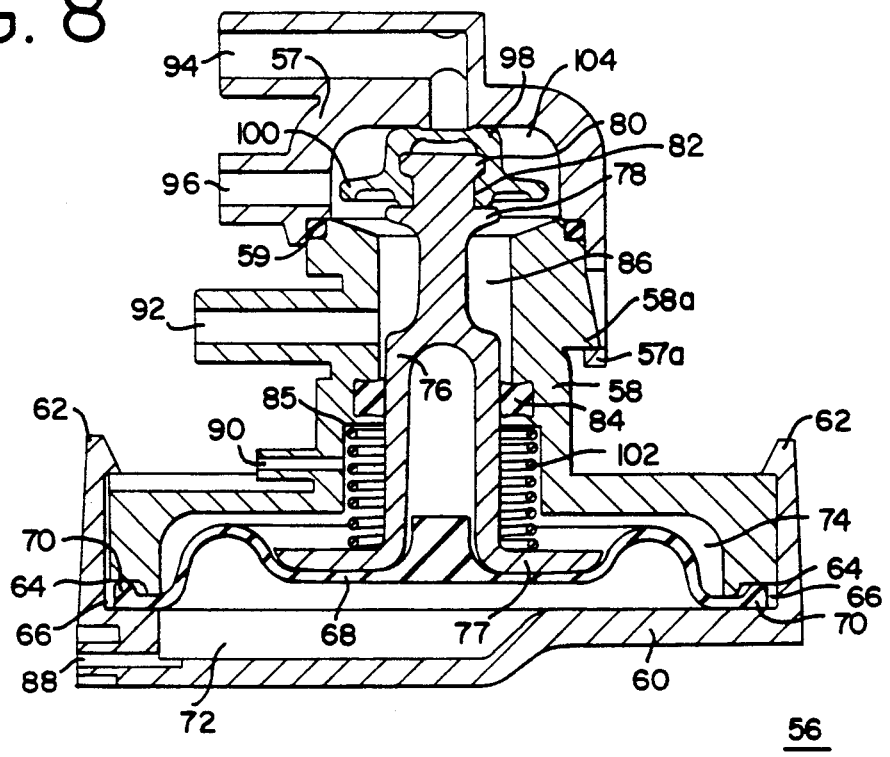
FIG. 8 is the same as FIG. 7 except that the controller valve is in the actuated position.

Controller valve 56 is illustrated in FIGS. 7 and 8. It comprises an upper housing 57, a middle housing 58, and a lower housing 60. Upper housing 57 is connected to middle housing 58 by means of a snap fit flanges 57*a* and 58*a*, respectively, and the walls of lower housing 60 terminate in flanges 62, which snap fit around the base portion of middle housing 58 to create the controller housing. Rubber O-ring 59 is positioned between the upper and middle housings to provide an air and liquid-tight seal. The bottom surface of middle housing 58 features stepped lip 64, which cooperates with the inner surface of lower housing 60 to create annular niche 66. Positioned between the mating middle and lower housings 58 and 60, respectively, is a flexible diaphragm 68 made of a rubber-like material, which includes a lip 70 along its peripheral edge to engage annular niche 66 in a locking position. Diaphragm 68 serves to divide the controller housing into a first chamber 72 and a second chamber 74, and to ensure an air and liquid-tight seal between the two housings.

Seated against diaphragm 68 and extending into middle and upper housings 58 and 57, respectively, is plunger 76, which has lips 78 and 80 extending laterally near its distal end, which cooperate to form annular niche 82. Contained between the lateral edge of plunger 76 and a step located midway along the inside surface of middle housing 58 is rubber seal 84. This seal serves two functions: it divides the middle housing into second chamber 74 and vacuum chamber 86, and it provides an air and liquid-tight seal between these two chambers.

Located near the bottom of lower housing 60 is inlet port 88, which serves to communicate the pressure condition delivered by sensor valve 24 into first chamber 72. First vacuum inlet port 90, in turn, delivers vacuum pressure into second chamber 74 at all times. Middle housing 58 also includes a second vacuum inlet port 92, while upper housing 57 includes an atmospheric air inlet port 94 located along its top side. At a lower position on upper housing 57 is outlet pressure port 96.

A U-shaped cap 98 made from a rubber-like material engages annular niche 82 of plunger 76 to surround its distal end. The cap includes flange 100 radiating laterally from its lower edge. Spring 102 is positioned between lip 77 of plunger 76 and washer 85 to bias cap 98 away from atmospheric air port 94.

When vacuum or subatmospheric pressure is delivered by sensor valve 24 to first chamber 72 of controller valve 56, equal pressure is applied across both sides of diaphragm 68, and spring 102 biases plunger 76 and cap 98 away from engagement with atmospheric air port 94, causing flange 100 to engage the inner wall of middle housing 58. In so doing, vacuum or subatmospheric pressure from vacuum chamber 86 is shut off, and atmospheric pressure is delivered instead to control chamber 104 and therefore to outlet port 96 (see FIG. 7). On the other hand, if atmospheric pressure is delivered to first chamber 72, the differential pressure applied across diaphragm 68 overcomes the force of spring 102, causing plunger cap 98 to abut atmospheric air port 94 and open a passage from vacuum chamber 86 (see FIG. 8). Now vacuum or subatmospheric pressure is communicated to control chamber 104 and through outlet port 96.

Figure 9:
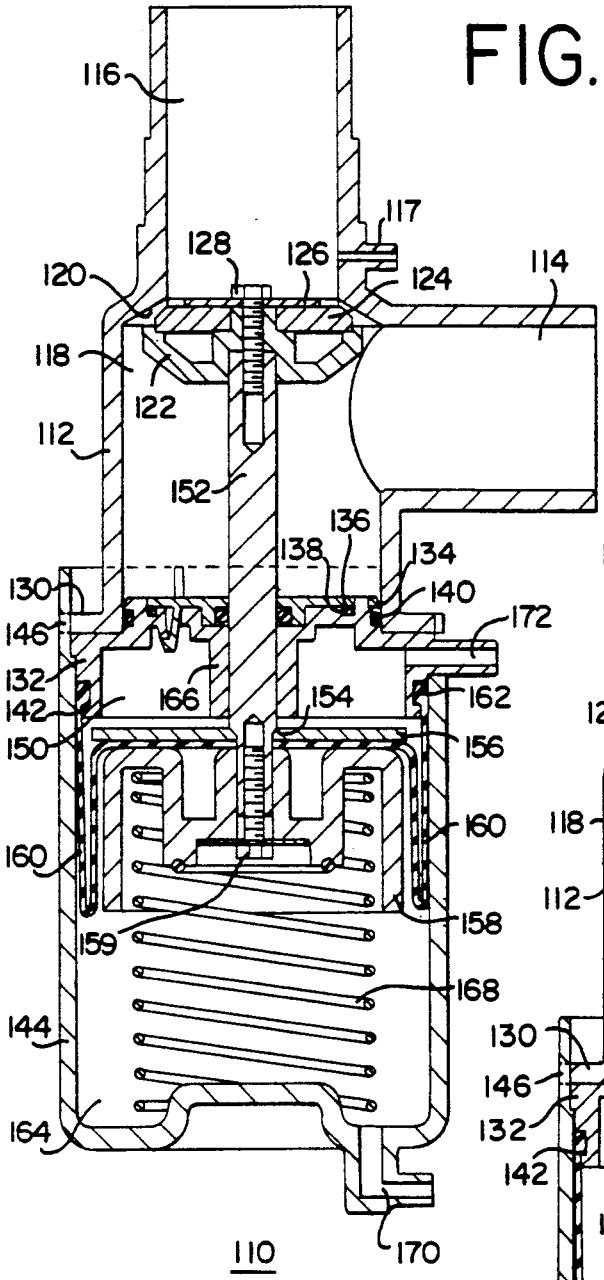
FIG. 9 is a cross-sectional view of the vacuum valve in the closed position.
Figure 10:
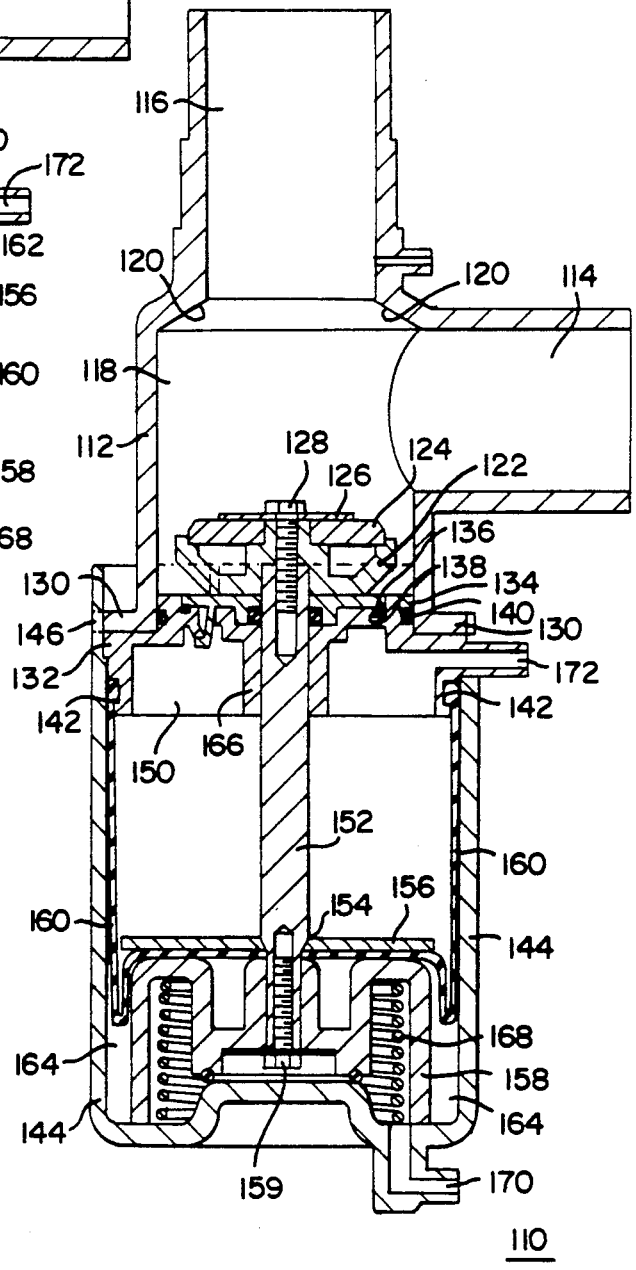
FIG. 10 is the same as FIG. 9 except that the valve is in the open position.

Vacuum valve 110 is illustrated in FIGS. 9 and 10. It includes an el-body portion 112, having an inlet pipe 114, an outlet pipe 116, and a valve chamber 118. Located at the entrance of the outlet pipe portion of the L-body 112 is a beveled valve stop 120. The valve stop cooperates with plunger 122 to separate the inlet and outlet pipes. While the valve is preferably 1.25 inches in size, it could bear any other dimension appropriate for a given application.

Inlet pipe 114 is connected to sump 12 by means of aperture 20. Outlet pipe 116, in turn, is connected to a transport conduit network (see FIGS. 13*a, b, c*) maintained under vacuum or subatmospheric pressure. Valve seat 124 made from a resilient rubber-like material is fitted over the distal end of plunger 122 and fastened by means of washer 126 and bolt 128. When plunger 122 engages valve stop 120, valve seat 124 ensures a liquid and air-tight seal.

The portion of valve housing 112 opposite the inlet pipe end terminates with a plurality of flanged lips 130. Seated slightly inside valve housing 112 and abutting flanged lips 130 is partition cup 132. Niches 134 and 136 located near the base of partition cup 132 accommodate rubber seals 138 and 140, which provide liquid and air-tight seals between valve chamber 118 and partition cup 132. Located along the outside surface of partition cup is annular groove 142.

Figure 11A:
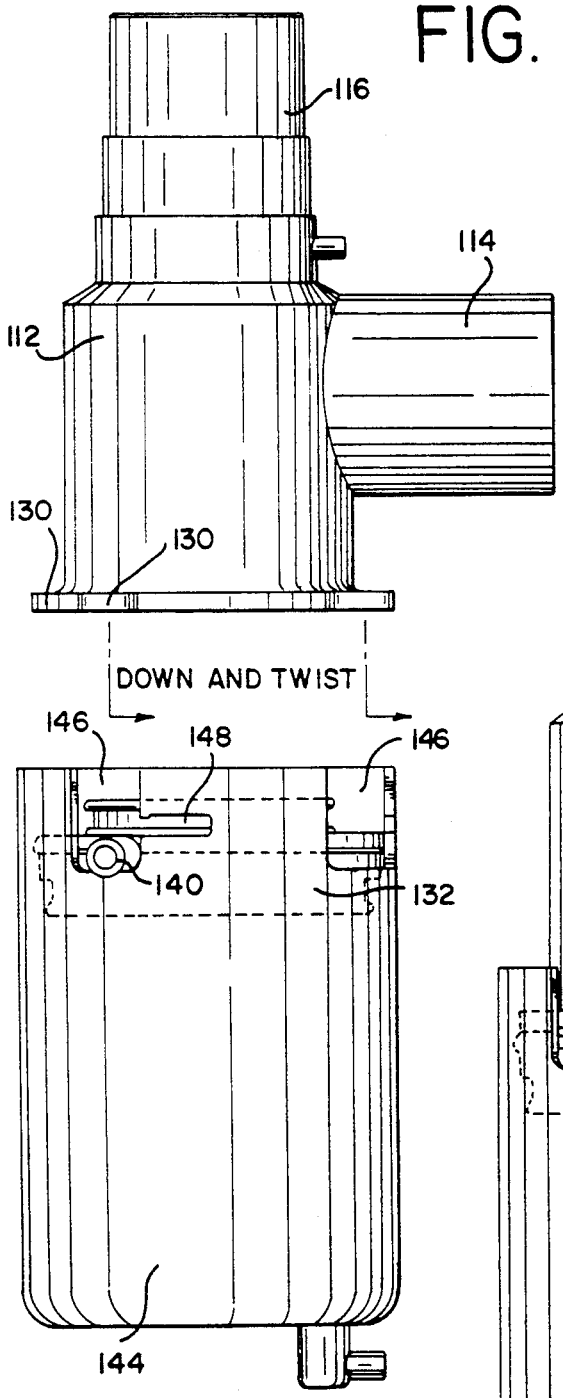
FIGS. 11*a* and 11*b* are side views of the vacuum valve of FIGS. 9 and 10 in the disassembled and assembled state, respectively.
Figure 11B:
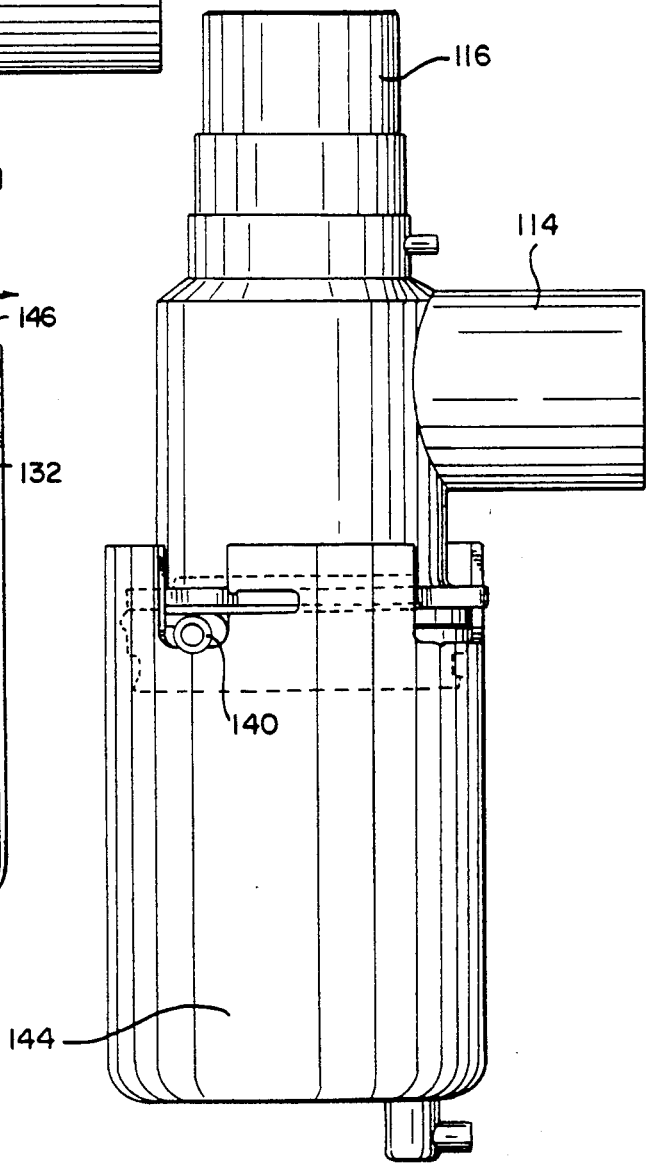

Piston housing 144 is cup-shaped, and has a plurality of longitudinal niches 146 with lateral extension niches 148 positioned along the open end of the piston housing. When piston housing 144 is set over el-body 112, flanged lips 130 enter longitudinal niches 146. By twisting the el-body, the flanged lips 130 enter the lateral niches 148 to provide locked engagement between the two housing components (see FIGS. 11*a* and 11*b*). Piston housing 144 and partition cup 132 cooperate to form lower valve chamber 150.

Extending from the backside of plunger 122, and secured by means of bolt 128, is piston shaft 152. Near the opposite end of the piston shaft is a stepped niche 154 against which is abutted piston plate 156 and piston cup 158 with piston shaft 152 extending therethrough, and secured by bolt and washer 159. Positioned between the piston plate and piston cup, and around the piston shaft, is a large resilient diaphragm 160 formed from a rubber-like material. The distal edge of the diaphragm terminates with flanged lip 162, which cooperates with annular groove 142 located along the outside surface of partition cup 132 to secure diaphragm 160. The diaphragm serves to divide upper valve chamber 164 from lower valve chamber 150.

An annular wall 166 extending from partition cup 132 provides a bearing for piston shaft 152 to ensure proper alignment of valve seat 124 with respect to valve stop 120. A spring 168 positioned between piston cup 158 and the inner surface of piston housing 144 biases plunger 122 against valve stop 120.

A pressure inlet port 170 delivers the pressure condition communicated by controller valve 56 to the upper chamber 164 of vacuum valve 110. At the same time, atmospheric pressure is communicated constantly to lower valve chamber 150 by means of atmospheric port 172. When atmospheric pressure is delivered by controller valve 56 to the upper valve chamber, equal pressures are applied across diaphragm 160, and spring 168 biases piston Cup 158, and by extension plunger 122, against valve stop 120 to maintain vacuum valve 110 in the closed position (See FIG. 9). By contrast, when vacuum or atmospheric pressure is delivered to upper valve chamber 164, the differential pressure applied across diaphragm 160 overcomes the force of spring 168 to cause plunger 122 to move away from valve stop 120 (see FIG. 10). At this point in time, waste liquid 14 at atmospheric pressure is withdrawn from sump 12 and conveyed through the open valve to the vacuum or subatmospheric pressure condition prevailing in the conduit network to commence a transport cycle. When atmospheric pressure is communicated once again to upper valve chamber 164, the process reverses, vacuum valve 110 closes, and the transport cycle is terminated.

Figure 12:
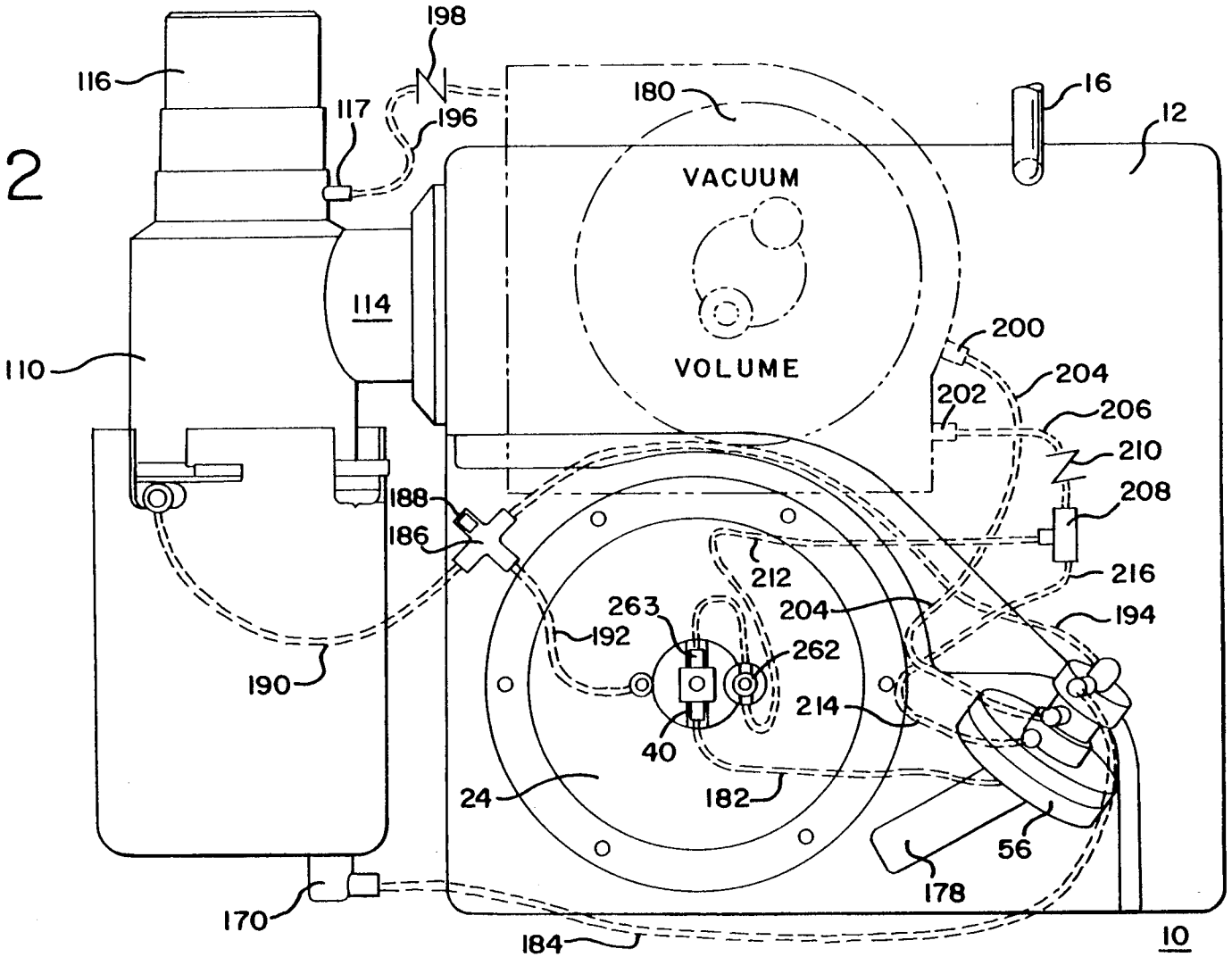
FIG. 12 is a plan view of the package system of the present invention.

An operational package system 10 is illustrated in FIG. 12. It includes sump 12, sensor valve 24, controller valve 56, vacuum valve 110, and vacuum volume 180. Vacuum volume 180 is designed to fit around sensor valve 24 in order to provide a more compact package system 10, but is drawn in phantom lines to the side to illustrate the sensor valve more clearly. Likewise, controller valve 56 is shown in a tilted position, and channel 178 accommodates hose 182 beneath the base of the controller valve.

As already indicated, inlet pipe 114 of vacuum valve 110 is connected to sump 12 to withdraw waste liquid 14. Outlet pipe 116 of vacuum valve 110 is connected to a transport conduit under vacuum pressure (see FIG. 13). Tube 182 communicates the output pressure condition of sensor valve 24 to inlet port 88 of controller valve 56. Tube 184, on the other hand, communicates the outlet pressure condition from outlet port 96 of controller valve 56 to inlet port 170 of vacuum valve 110.

Breather-tee 186 has an aperture 188 for intaking atmospheric air. The air at atmospheric pressure is communicated, in turn, to: lower valve chamber 150 of vacuum valve 110 by means of tube 190; second chamber 32 of sensor valve 24 by means of tube 192; and atmospheric inlet port 94 of controller valve 56 by means of tube 194.

Vacuum or subatmospheric pressure, in turn, is withdrawn from outlet pipe 116 of vacuum valve 110 to vacuum volume 180 by means of outlet port 117 and tube 196. The vacuum volume is merely a reservoir of predetermined volume (e.g., 0.1–0.3 liters), which ensures that an adequate supply of vacuum/subatmospheric pressure is available during a transport cycle as the withdrawn waste liquid at atmospheric pressure passes through vacuum valve 110 during a transport cycle, and displaces the vacuum/subatmospheric pressure condition in the conduit immediately downstream thereof until the valve is closed. A check valve 198 is interposed in tube 196 to prevent waste liquid passing through the vacuum valve from migrating into vacuum volume 180. In some cases, for example, where the package system 10 discharge piping must discharge vertically upwards for more than eight feet, the vacuum volume may be eliminated, or the vacuum supply to the vacuum volume tube 196 shall not be connected to vacuum valve connector 177, and shall be connected instead to the top of discharge conduit 222 (see FIG. 10*a*). In these cases, a check valve 265 may be installed at the top of discharge conduit 222, and the package system 10 vacuum supply will be taken from immediately downstream of the check valve.

Vacuum volume 180 has two outlet ports 200 and 202, respectively. Outlet port 200 is connected to inlet port 92 of controller valve 56 by means of tube 204, and thereby delivers vacuum/subatmospheric pressure to upper chamber 86 of controller valve 56. Tube 206 connects outlet port 202 to tee-junction 208, and has check valve 210 interposed therein. Vacuum/subatmospheric pressure is communicated, in turn, to sensor valve 24 by means of tube 212, while tube 214 communicates vacuum/subatmospheric pressure to vacuum inlet port 90 of controller valve 56, and thereby to second chamber 74 therein. Adjustment screw 262 (See FIGS. 3-6 and 12) represents a variable restrictor on tube 212 by means of a deflected ball 264, thereby restricting the communication of vacuum/subatmospheric pressure to controller valve 56 to adjust the duration of the transport cycle.

The operation of package system 10 is as follows. Waste liquid 14 accumulates in sump 12 through inlet pipe 16. Vacuum valve 110 is in the closed, standby position (see FIG. 9). When the hydrostatic pressure exerted against diaphragm 28 of sensor valve 24 becomes sufficiently great, plunger post 36 is reciprocated in channel 38 (see FIGS. 4 and 6). At this position, atmospheric pressure in second chamber 32 passes through undercut region 46 of plunger post 36 into channel 38, and thereby through nozzle 40, tube 182, and inlet port 88 into first chamber 72 of controller valve 56. The atmospheric pressure then presses against diaphragm 68 to reciprocate plunger 76 so that cap 98 compressibly closes atmospheric air port 94, and then opens a channel to vacuum chamber 86 when flange 100 releases (see FIG. 8). The vacuum/subatmospheric pressure in chamber 86 passes through outlet port 96, tube 184, and inlet port 170 to upper valve chamber 164 of vacuum valve 110.

The atmospheric pressure in lower valve chamber 150 deflects diaphragm 160 to cause plunger 122 and valve seat 124 to disengage valve stop 120 to bring the vacuum valve 110 to its open position (see FIG. 10). A transport cycle is commenced, and waste liquid 14 passes from sump 12 through vacuum valve 110 into the vacuum transport conduit.

Figure 5:
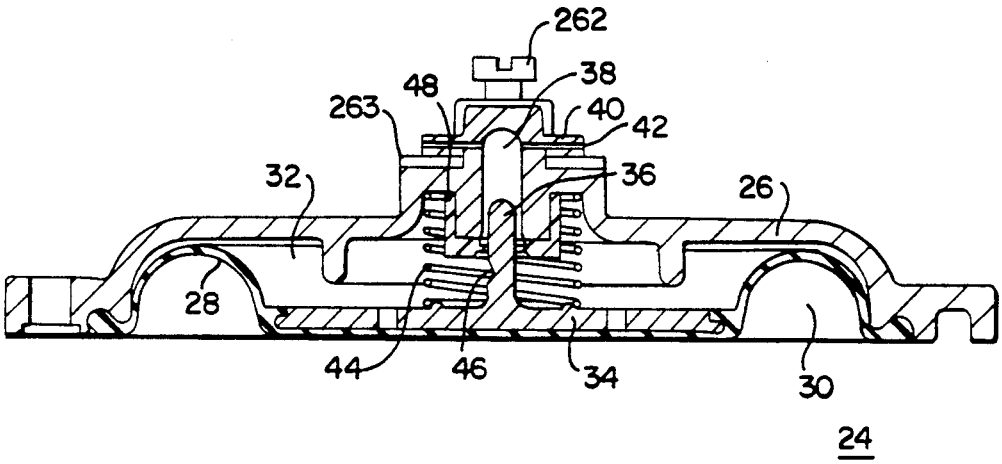
FIG. 5 is a cross-sectional view of the sensor valve in the standby position taken along line 5—5 of FIG. 2.
Figure 6:
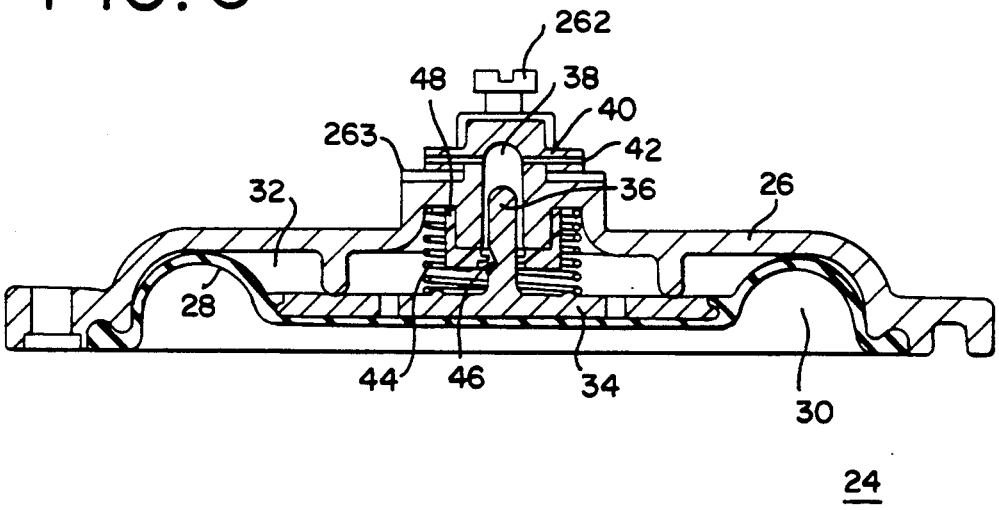
FIG. 6 is a cross-sectional view of the sensor valve in the actuated position taken along line 6—6 of FIG. 2.

After the waste liquid and a quantity of atmospheric air have passed through vacuum valve 110, the hydrostatic pressure exerted against diaphragm 28 of sensor valve 24 will diminish to the point that spring 44 deflects pressure plate 34, causing plunger post 36 to reciprocate from channel 38 (see FIGS. 3 and 5). At this position, undercut region 46 in plunger post 38 lies below rubber seal 48, and atmospheric pressure cannot pass from second chamber 32 into channel 38. Vacuum/subatmospheric pressure is communicated from vacuum volume 180 through tee 208, tube 212, variable restrictor 262, and nozzle 263 to channel 38 instead, and thereby through nozzle 40, tube 182 and inlet port 88 to first chamber 72 of controller valve 56.

Spring 102 biases lip 77 of plunger 76 so that flange 100 of cap 98 seals vacuum chamber 86, causing cap 98 to disengage atmospheric pressure port 94 (see FIG. 7). Atmospheric pressure passes from control chamber 104 through outlet port 96, tube 184, and inlet port 170 to upper valve chamber 164 of vacuum valve 110. Spring 168 biases piston cup 158, and therefore plunger 122 and valve seat 124, against valve stop 120 to close the valve (see FIG. 9), and thereby terminates a transport cycle. No more waste liquid may pass through the valve.

Figure 13A:
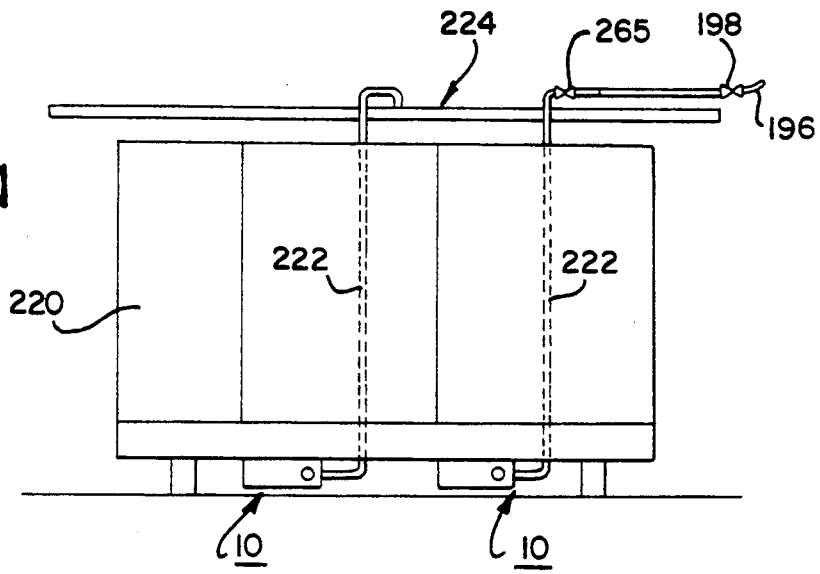
FIGS. 13*a*, 13*b*, and 13*c* are schematic views of several applications of the package system of the present invention.

The package system of the present invention is compact, occupying a volume generally measuring 12"×8"×3½," which is small enough to be placed unobtrusively in most applications. Various applications of package system 10 are illustrated in FIG. 13. In FIG. 13*a*, a commercial freezer unit 220 creates waste liquid when it is condensed, cleaned, or defrosted. Instead of encasing drain pipes in the cement floor and connecting them to the gravity sewage system serving the commercial facility, as is commonly done in the industry, one or more package systems 10 are positioned on the floor beneath the freezer unit 220. Waste liquid is drained directly into sump 12, and transported during a transport cycle through valve 110 and pipe 222 into a pipe 224 suspended from the ceiling. Pipe 224 is connected to the vacuum sewage system (not shown). Pipes 222 and 224 may be formed from 1.25 and 2-inch PVC conduit, respectively. In this way, water may be evacuated expeditiously from freezer 220, and the package system 10 and pipes 222 and 224 are easily installed and maintained.

Figure 13B:
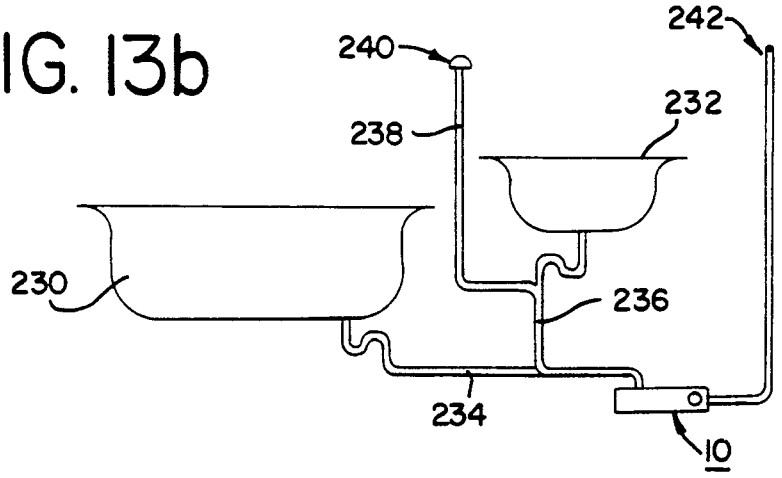

A different application is illustrated in FIG. 13*b* for a bathtub 230 and sink 232. The bath tub and sink drain their gray water into package system 10 by means of pipes 234 and 236, and pipe 238 and vent 240 provide atmospheric pressure to the system. Vacuum valve 110 is connected directly to pipe 242, which, in turn is connected to the vacuum service system servicing the house or business establishment.

Figure 13C:
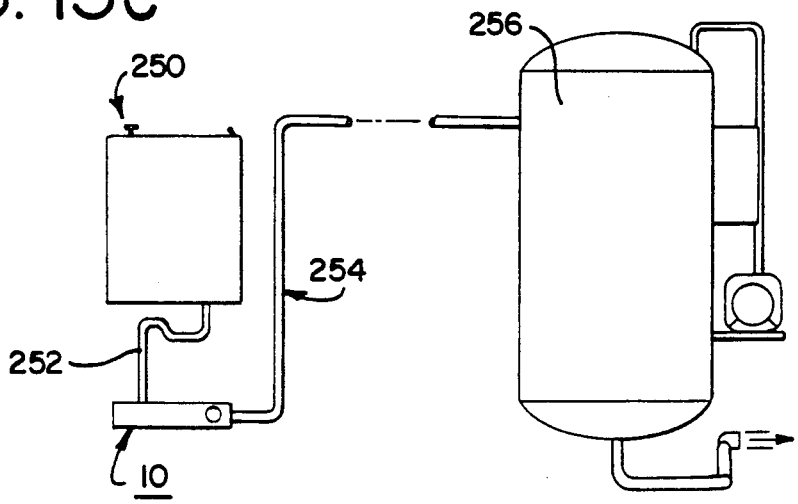

Finally, a water fountain 250 is illustrated in FIG. 13*c*, which drains unused and contaminated water to package system 10 by means of pipe 252. Pipe 254, in turn, extends from vacuum valve 110 to the vacuum transport conduit servicing the school or commercial establishment, and thence to the vacuum collection station 256.

While particular embodiments of the invention have been shown and described, it should be understood that the invention is not limited thereto, since many modifications may be made. For instance, the housing components of vacuum valve 110 may be connected by means of snap-fit tabs instead of the twist-and-lock mechanism described in the present application. Moreover, while the vacuum valve is preferably el-body in shape to provide a more compact system package, it could adopt any other shape such as a wye-body. The invention is therefore contemplated to cover by the present application any and all such modifications which fall within the true spirit and scope of the basic underlying principles disclosed and claimed herein.

What is claimed is:

1. An integrated package system for accumulating waste liquids from a source, and transporting them to a vacuum transport conduit and associated vacuum collection station, the package system comprising:

a. a collection vessel connected to the waste liquid source for accumulating a predetermined volume of the waste liquid;

b. a source of vacuum or subatmospheric pressure;

c. a source of atmospheric pressure;

d. differential pressure-operated sensing means operatively in communication with said collection vessel for establishing communication of one of those pressure conditions as an output pressure condition, said sensor means having a first inactivated condition, and a second activated condition arising when the predetermined waste liquid volume is accumulated within said collection vessel, whereby vacuum or subatmospheric pressure is delivered while said sensor means is in one condition, and whereby atmospheric pressure is delivered while said sensor means is in another condition;

e. differential pressure-operated controller means operatively in communication with the output pressure condition delivered by said sensor means for establishing communication of one of those pressure conditions as an output pressure condition, said controller means having a first condition and a second condition, whereby vacuum or subatmospheric pressure is delivered while said controller means is in one condition, and whereby atmospheric pressure is delivered while said controller means is in another condition; and f. differential pressure-operated barrier means operatively in communication with the output pressure condition delivered by said controller means, said barrier means having an open condition to permit passage of waste liquid from said collection vessel to the vacuum transport conduit and thereby commence a waste liquid transport cycle therein, said barrier means also having a closed condition to block passage of waste liquid therethrough and thereby terminate the transport cycle, whereby said barrier means converts between the open and closed conditions based upon the pressure condition delivered by said controller means, said integrated package system being self-contained for portability and simple installation, and having an overall dimension such that the volume of said collection vessel container therein is less than about 8 liters.

2. A package system as recited in claim 1, wherein the volume of said collection vessel is about 1.0–3.0 liters.

3. A package system as recited in claim 1, wherein said sensor means comprises a 2-way, 2-position spool valve.

4. A package system as recited in claim 3, wherein said spool valve is actuated by the hydrostatic pressure arising from the accumulated waste liquid in said collection vessel.

5. A package system as recited in claim 4, wherein said 2-position, 2-way spool valve comprises:

a. a housing;

b. a pliable diaphragm connected to said housing in an air-tight manner to divide said housing into a first chamber and a second chamber;

c. an inlet means in a wall of said housing for admitting hydrostatic pressure from said collection vessel into the first chamber to bear against said diaphragm;

d. an aperture in a wall of said housing having an annular wall depending therefrom into the second chamber to form a channel, said channel communicating externally by means of a nozzle connected to said housing over said aperture;

e. a plunger shaft contained by the second chamber and having a first end and a second end, said first end seated against said diaphragm, said second end reciprocating inside the channel, sealing means being positioned between said plunger shaft and the annular wall to provide an air-tight seal;

f. spring means positioned between said diaphragm and said housing to bias said diaphragm away from the channel; and g. an undercut passage positioned in a portion of one side of said plunger shaft, whereby said undercut passage generally is positioned completely within the second chamber to prevent a pressure condition existing in the second chamber from being communicated to the channel, and whereby when the hydrostatic pressure exerted on said diaphragm overcomes the force exerted by the spring, said plunger shaft is reciprocated inside the channel so the undercut passage therein interconnects the second chamber to the channel to communicate a pressure condition existing in the second chamber to the channel.

6. A package system as recited in claim 3, further comprising timing means for adjusting the duration of the transport cycle.

7. A package system as recited in claim 6, wherein said timing means comprises means for adjusting the size of the bore of a hose communicating the output pressure condition from said sensor means to said controller means.

8. A package system as recited in claim 7, wherein said adjusting means comprises a screw.

9. A package system as recited in claim 1, wherein said controller means comprises a 3-way, 2-position spool valve.

10. A package system as recited in claim 9, wherein said 3-way, 2-position spool valve is actuated by application of differential pressure.

11. A package system as recited in claim 10, wherein said spool valve comprises:

a. a housing;

b. a pliable diaphragm connected to said housing in an air-tight manner to divide said housing into a first chamber and a second chamber;

c. first inlet means in a wall of said housing to admit the output pressure condition communicated by said sensor means into the first chamber;

d. a plunger shaft having a first end and a second end, the first end seated against said diaphragm, the second end having secured thereto a flanged cap made of a resilient material, sealing means positioned along the interior of the housing wall interacting with said plunger shaft to separate a third chamber from said second, chamber;

e. an outlet chamber positioned within said housing in operative communication with the third chamber;

f. second inlet means positioned in a wall of said housing for admitting vacuum or subatmospheric pressure to the second chamber;

g. third inlet means positioned in a wall of said housing for admitting vacuum or subatmospheric pressure to the third chamber;

h. fourth inlet means positioned in a wall of said housing for admitting atmospheric pressure to the outlet chamber;

i. outlet means positioned in the housing wall for venting the pressure condition contained in the outlet chamber; and j. spring means positioned between said diaphragm and the wall of the second chamber, whereby the flanged cap secured to said plunger shaft generally closes pressure communication between the third chamber and the outlet chamber so atmospheric pressure is delivered through the outlet means to said barrier means, and whereby differential pressure exerted against said diaphragm causes the flanged cap to close the fourth inlet means so vacuum or subatmospheric pressure is delivered instead through the outlet means.

12. A package system as recited in claim 1, wherein said barrier means comprises a vacuum valve, having an open position and a closed position.

13. A package system as recited in claim 12, wherein said vacuum valve is actuated by means of differential pressure.

14. A package system as recited in claim 13, wherein said vacuum valve comprises:

a. a valve body having an entry opening and an exit opening;

b. a valve stop in said valve body disposed to separate the openings when the valve is in the closed position;

c. a rigid valve plunger disposed for reciprocating movement in said valve body relative to said valve stop to alternately open and close the valve, said plunger having a first end and a second end, said plunger having seating means on the first end of the plunger matable with said valve stop to provide closure of the valve; and d. a coaxially disposed shaft connected at its first end to the first end of the rigid valve plunger and passing through the plunger, and at its second end to control means for selectively opening and closing said valve in response to the output pressure condition delivered by said controller means.

15. A package system as recited in claim 14, wherein the seating means on the first end of said plunger comprises an assembly of coaxially disposed seating elements arranged to provide a generally annular beveled seating means which will eliminate the collection of foreign objects between said elements and assure valve closure.

16. A package system as recited in claim 14, wherein shaft sealing means are provided relative to said plunger, without coming into contact with said valve stop to preclude fluid leakage around the shaft when said valve is closed.

17. A package system as recited in claim 14, wherein replaceable bearing means are provided between the rigid valve plunger and the control means for directing the shaft and the plunger carried thereby in a predetermined angular relationship with said valve stop, and to assure closure during repetitive operations of the valve.

18. A package system as recited in claim 17, wherein sliding liquid-tight shaft sealing means are disposed adjacent to the bearing means, the shaft sealing means being adapted to prevent migration of fluid and fluid-borne contaminants along the shaft and into the control means.

19. A package system as recited in claim 14, wherein said control means for selectively opening and closing said vacuum valve comprises a piston means disposed to slide in a centrally disposed vacuum chamber within said valve body.

20. A package system as recited in claim 14, wherein said valve body comprises a plurality of valve housings connected by means of twist locks.

21. A package system as recited in claim 14, wherein said valve body comprises a plurality of valve housings connected by means of snap-fit locks.

22. A package system as recited in claim 14, wherein said valve body is el-shaped.

23. A package system as recited in claim 14, wherein said valve body is wye-shaped.

24. A package system as recited in claim 12 wherein said vacuum vale comprises, in part, a throughput bore for passage of waste liquids measuring approximately 1.25 inches in diameter.

25. A package system as recited in claim 1, wherein said source of vacuum or subatmospheric pressure comprises the vacuum transport conduit.

26. A package system as recited in claim 1, further comprising a container of predetermined volume operatively in communication with said source of vacuum or subatmospheric pressure for ensuring a reliable source of vacuum or subatmospheric pressure during a waste liquid transport cycle.

27. A package system as recited in claim 26, wherein said container comprises a vessel having a volume of about 0.1–0.3 liters.

28. A package system as recited in claim 1, wherein said integrated components fit within a collective volume generally measuring about $12'' \times 8'' \times 3\frac{1}{2}''$.

29. A package system as recited in claim 1 for collecting and transporting to a vacuum transport conduit waste liquids, wherein the source comprises a freezer.

30. A package system as recited in claim 1 for collecting and transporting to a vacuum transport conduit waste liquids, wherein the source comprises a sink or bathtub.

31. A package system as recited in claim 1 for collecting and transporting to a vacuum transport conduit waste liquids, wherein the source comprises a drinking fountain.

* * * * *